US006695643B2

(12) United States Patent
Wu

(10) Patent No.: US 6,695,643 B2
(45) Date of Patent: Feb. 24, 2004

(54) LAMP SHAFT OF A DO-IT -YOURSELF LAMP

(76) Inventor: Wen-Chang Wu, 235 Chung-Ho Box 8-24, Taipei (TW)

( * ) Notice: Subject to any disclaimer, the term of this patent is extended or adjusted under 35 U.S.C. 154(b) by 159 days.

(21) Appl. No.: 09/994,451

(22) Filed: Nov. 28, 2001

(65) Prior Publication Data

US 2003/0100222 A1 May 29, 2003

(51) Int. Cl.[7] ..... H01R 13/73
(52) U.S. Cl. ..... 439/545; 174/65 R
(58) Field of Search ..... 174/48, 50, 50.6, 174/65 R; 439/545, 549

(56) References Cited

U.S. PATENT DOCUMENTS 6,080,933 A * 6/2000 Gretz ..... 174/65 R
6,248,952 B1 * 6/2001 Reeves et al. ..... 174/65 R
6,441,302 B1 * 8/2002 Wu ..... 174/50
6,489,560 B1 * 12/2002 Wu ..... 174/65 R

* cited by examiner

*Primary Examiner*—Javaid H. Nasri
*Assistant Examiner*—Thanh-Tam Le

(57) ABSTRACT

A lamp shaft of a Do-It-Yourself (DIY) lamp fixing in a wire connection casing composes a fixing base and an inserting shaft. The fixing base is coupled and secured to a through hole on the lateral side of a wire connection casing. An inserting shaft is inserted into the through hole of the fixing base. By rotating the inserting shaft, the embedding member and the slanted elastic plate are driven to press tighter and tighter with each other and forces the embedding base to be securely fixed onto the fixing base. Such arrangement can reduce the transportation and storage amount of material since the wire connection casing and the inserting shaft can be detached and disposed separately. Furthermore, when the user carries the lamp, he/she does not need other tools for assembly, and it attains the function of facilitating the user's DIY assembly.

4 Claims, 2 Drawing Sheets

LAMP SHAFT OF A DO-IT -YOURSELF LAMP

BACKGROUND OF THE INVENTION

1. Field of the Invention

The present invention relates to lamp shafts of lamps, and more particularly to a lamp shaft of a Do-It-Yourself (DIY) lamp.

2. Description of the Prior Art

In general, the conventional wire connection casing and the inserting shaft structure, such as those utilized for wall lamps, table lamps, or floor lamps, make use of screws and nuts in assembling work. However, such assembling method by using screws and nuts may damage finished goods very easily in the assembly process, and also requires tools such as wrenches, screwdrivers, etc. for assembly. In addition, the friction during assembling work may cause the electric wire to exposed out and give rise to an electric shock. This is a trouble in the assembly process, and thus it become not suitable for DIY assembly. Therefore, manufacturers should connect the wire connection casing with the inserting shaft in advance before selling the lamp, but this will increase the volume of materials for transportation, and will increase cost

SUMMARY OF THE INVENTION

Therefore, the primary objective of the present invention is to provide a lamp shaft structure for a DIY lamp applicable for chandelier, wall lamp, or floor lamp, composed of a fixing base that is coupled and secured to a through hole on the lateral side of a wire connecting casing; and an inserting shaft that is inserted into the through hole of the fixing base. Two symmetrical rotary grooves are disposed in opposite directions on an end of the fixing base. A slanted rotary elastic plate is latched to the groove, and two guiding grooves in the shape of a strip are disposed on the periphery of the through hole at the latched end of the fixing base in order to guide the front end of the inserting shaft to slide along the guiding groove of the fixing base, and to protrude out of the elastic plate. Each side of the protruded portion has an embedding member. By rotating the inserting shaft, it drives the embedding member and the slanted elastic plate to press closer and tighter with each other and forces the embedding base to be securely fixed to the fixing base.

Another objective of the present invention is to provide a lamp shaft structure for a DIY lamp (III) that uses the inserting shaft to rotate the embedding base in opposite direction in order to separate it from the pressing of the elastic plate, and then the inserting shaft can be taken out from the wire connection casing. It detaches the wire connection casing and the inserting shaft so that they can be put separately and thus reduces the volume of materials for transportation and storage. Further, the fixing base for the insertion of the inserting shaft has been assembled in the wire connection casing in advance, therefore when the user bought such lamp, he/she just needs to insert the inserting shaft into fixing base and rotates it until it is securely coupled to the fixing base. It also works together with a restricted ring for the positioning, and does not need to have any other tools for screwing, and it thus attains the effect of facilitating the DIY assembly.

The various objects and advantages of the present invention will be more readily understood from the following detailed description when read in conjunction with the appended drawing.

BRIEF DESCRIPTION OF THE DRAWINGS

Other objects, features, and advantages of the invention will become apparent from the following detailed description of the preferred but non-limiting embodiment. The description is made with reference to the accompanying drawings, in which.

DETAILED DESCRIPTION OF THE PREFERRED EMBODIMENT

Figure 1:
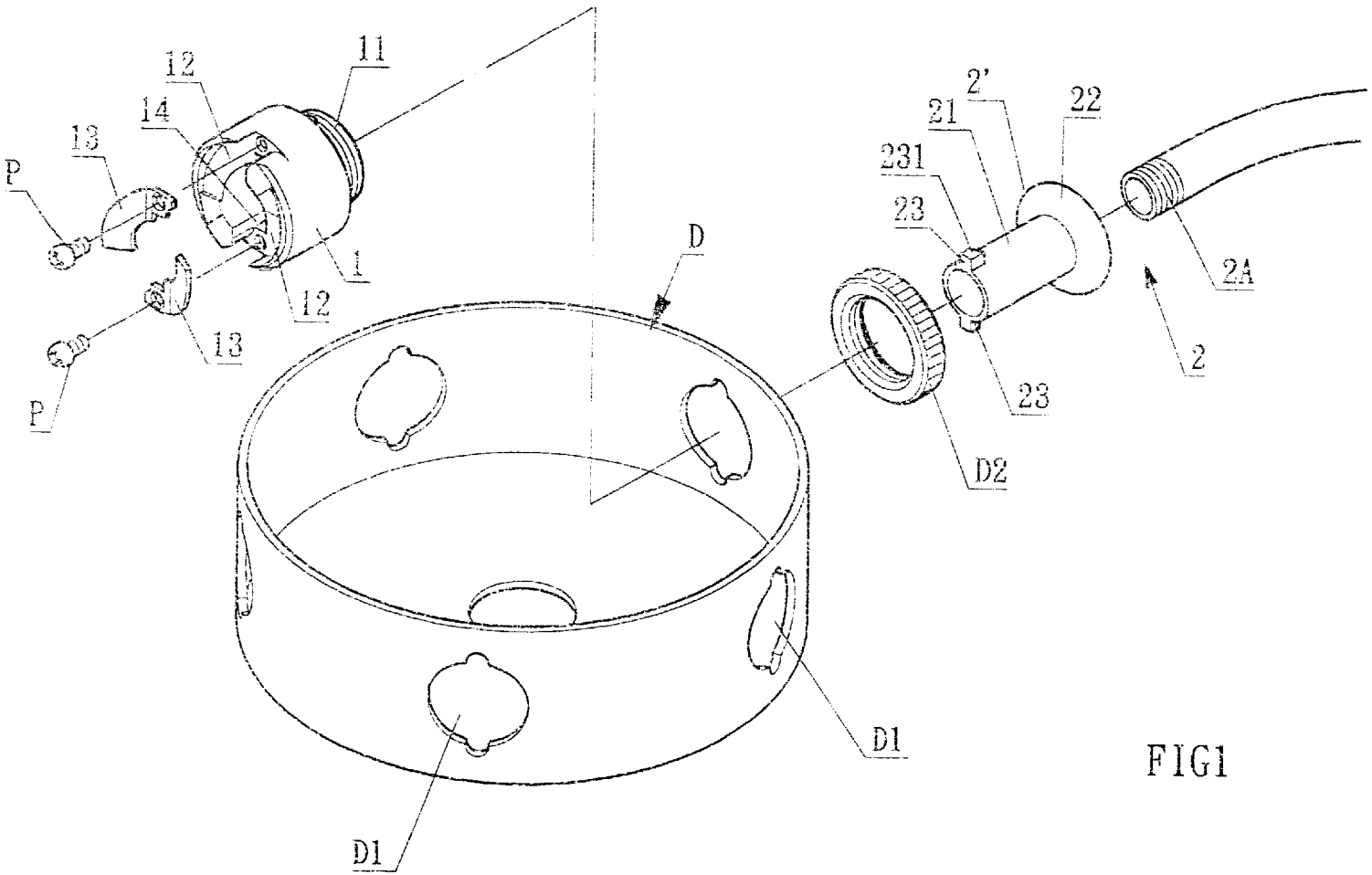
FIG. 1 is an exploded perspective view showing the parts of the present invention.

Referring to FIG. 1, the lamp shaft for a DIY lamp of the present invention is illustrated. In the present invention, the lamp shaft comprises a fixing base 1 being coupled to a lateral side of a wire connection casing D, and an inserting shaft 2 being inserted into an interior of the fixing base 1. A plurality of through holes D1 are disposed along a periphery of the wire connection casing D, and each side of the through hole D1 has a latch groove D11. The fixing base 1 installed at one end is extended with a coupling sheath 11. Thereby, it just passes through the through hole D1 of the wire connection casing D. The coupling sheath 11 is formed with a sheathing hole 111, and is aligned with both sides of the through hole D1 of the latch groove D11 and the coupling sheath 11 has a protruded member 112 for assisting the fixing positioning of the fixing base 1. After the coupling sheath 11 passes through the wire connection casing D, the outer side of the wire connection casing D is latched to the coupling sheath 11 of the fixing base 1 by using the fixing ring D2 and the fixing base is coupled to the inner side of the wire connection casing D in advance.

The other end of the fixing base 1 has two symmetric rotary-knifed grooves 12 disposed in opposite directions, and the rotary knifed groove 12 is coupled to the rotary-knifed elastic plate 13 by a screw P. The groove 12 and the elastic plate 13 are tilted from the latched end toward the other end. A crevice is disposed between the elastic plate 13 and the groove 12 for rotating the inserting shaft 2 into a fixing position. The edge of the sheathing hole 111 at the latched end of the fixing base 1 has two guiding grooves having a strip-like shape passing through both ends of the fixing base for assisting the insertion and positioning of the inserting shaft 2.

The front end of the inserting shaft 2 has a threaded section 2A, and the threaded section 2A is latched onto the embedding base 2' in advance. The embedding base 2' is a cylindrical structure having a shape like "T", and the ringed surface 21 of the embedding base can slide along the guiding groove 14 of the fixing base 1 and protrudes out of the rotary knifed elastic plate 13 such that the large ringed surface 22 resists against the ringed periphery of the wire connection casing D. The embedding base 2' at the end of both sides of its protruded section has an embedded blocking member 23, and the embedded blocking member 23 just presses against the middle section proximate to the upper portion of the elastic plate 13. The embedded blocking member 23 that resists against the elastic plate 13 is an embedded blocking surface 231 with a slope to assist against the sliding of the elastic plate 13.

Figure 2:
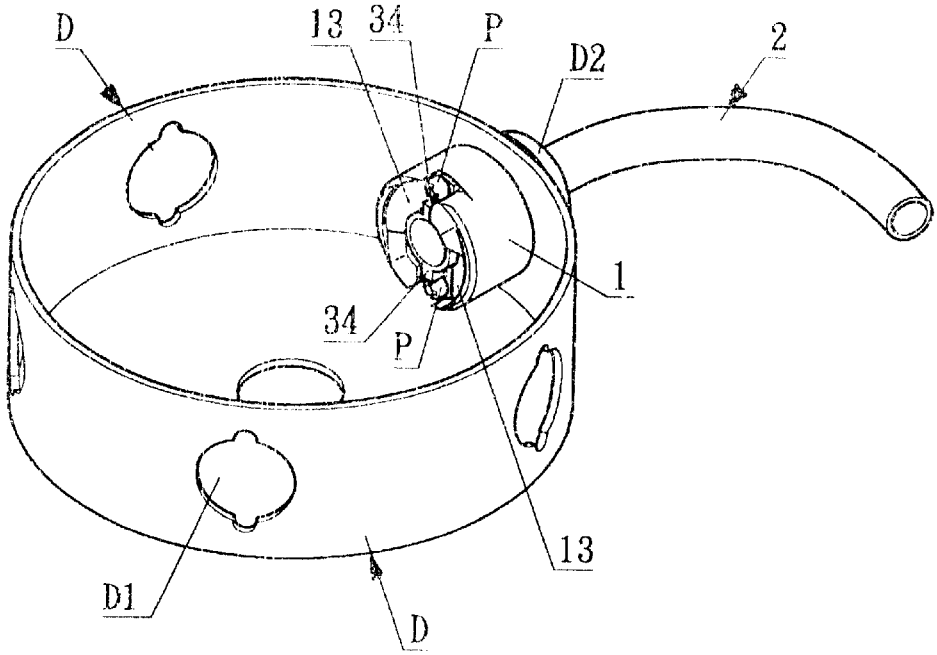
FIG. 2 is a plane view showing the assembled structure of the present invention when the inserting shaft is not securely coupled to a fixing base.
Figure 3:
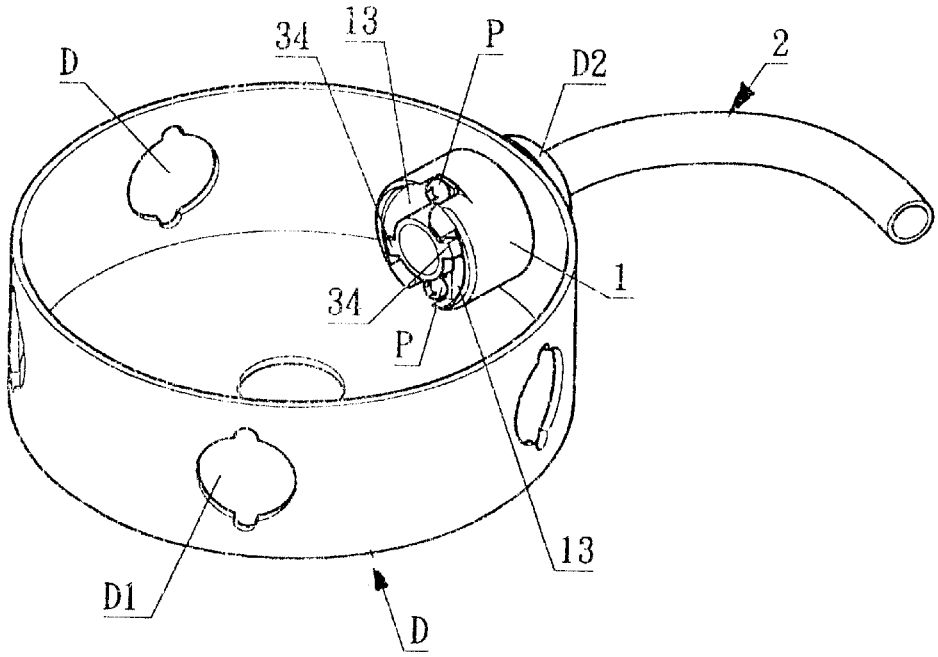
FIG. 3 is a plane view showing the assembled structure of the present invention when the inserting shaft is securely coupled to the fixing base.

Referring to FIGS. 2 and 3, the coupling sheath 11 of the fixing base 1 passes through the through hole D1 of the wire connection casing D, and the outer side of the wire connection casing D is latched to the coupling sheath 11 of the fixing base 1 by the fixing ring D2 for fixing the fixing base 1 to the inner side of the wire connection casing. It then works together with the embedding base 2' of the inserting shaft 2 to sheath into the fixing base. Thereby the embedded blocking member 23 on the embedding base 2 can successfully slide along the guiding groove 14, protrudes out of the rotary knifed elastic plate 13, and resists against the middle section proximate to the upper part of the elastic plate 13 as shown in FIG. 2.

Then, by means of the rotation of the inserting shaft 2, the pressure between the embedding member 23 and the elastic plate 13 is increased. By the elastic plate 13 and the embedded blocking member 23 latched to a side end of the elastic plate 13, the fixing base 1 is forced into a position by the embedding base 2' as shown in FIG. 3

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. A lamp shaft of a do it yourself lamp fixed to a wire connection casing, the wire connection casing having at least one first though hole on a periphery thereof; the lamp shaft comprising a fixing base coupled and secured to the at least one first through hole on a lateral side of the wire connection casing;

a coupling sheath exactly passing through the at least one first through hole of the wire connection casing and being extended from a side of the fixing base;

an elastic plate disposed on the other side of the fixing base for securely fixing an inserting shaft into position; and two guiding grooves having long strip shapes and being disposed on a periphery of a hole at the latched end of the fixing base for positioning the inserting shaft; and an inserting shaft inserted into a second through hole of the fixing base; said inserting shaft including:

a fixing ring disposed at a periphery of the inserting shaft and then being positioned by the two guiding grooves;

an embedding base at a front section of the inserting shaft, and being capable of sliding along the guiding grooves of the fixing base and protruding from the elastic plate, and the other end of the embedding base exactly resisting a periphery of the ring against the wire connection casing, and embedded blocking members being protruded from opposite sides of a protruded section of the embedding base, such that the embedded blocking member exactly resisting against the latched section between the elastic plate and the groove.

2. The lamp shaft as claimed in claim 1, wherein the wire connection casing has a latch groove on both sides of the first through hole, and two protruded members are disposed on both sides of the latch groove at the coupling sheath of the fixing base.

3. The lamp shaft as claimed in claim 1, wherein said fixing base has a pair of symmetrical rotary knifed groove disposed in opposite directions on the other end surface of the fixing base, and the elastic plate is latched on the rotary knifed groove, and the groove and elastic plate are both tilted from the latch end to the other end, and a crevice is disposed between the elastic plate and the groove to securely position the inserting shaft by rotation.

4. The lamp shaft as claimed in claim 1, wherein the embedding base disposed at the front section of the inserting shaft having an embedded blocking member which resisting against part of the elastic plate, and is an embedded pressing surface with a slope to facilitate the sliding action of the elastic plate.

* * * * *